US012778286B1

(12) United States Patent
Feagans et al.

(10) Patent No.: US 12,778,286 B1
(45) Date of Patent: Nov. 3, 2026

(54) UTILITY POLE STORAGE RACK

(71) Applicant: Blackwood Solutions, LLC, Bloomington, IN (US)

(72) Inventors: Jason Feagans, Bloomington, IN (US); Levi Painter, Bloomington, IN (US)

(73) Assignee: Blackwood Solutions, LLC, Bloomington, IN (US)

( * ) Notice: Subject to any disclaimer, the term of this patent is extended or adjusted under 35 U.S.C. 154(b) by 0 days.

(21) Appl. No.: 19/436,635

(22) Filed: Dec. 30, 2025

(51) Int. Cl.
*A47B 81/00* (2006.01)
*A47B 46/00* (2006.01)
*B65D 19/38* (2006.01)

(52) U.S. Cl.
CPC ..... *A47B 81/005* (2013.01); *A47B 46/00* (2013.01); *B65D 19/385* (2013.01)

(58) Field of Classification Search
CPC .... A47B 81/005; A47B 46/00; B65D 19/385; B65D 88/522; B65D 88/129
See application file for complete search history.

(56) References Cited

U.S. PATENT DOCUMENTS 2,699,911 A 1/1955 Chase et al.
2,956,763 A 10/1960 D'Arca
3,499,398 A 3/1970 Murray
3,565,018 A 2/1971 Jay
3,664,273 A 5/1972 Howe
4,353,520 A * 10/1982 Jansson ..... B65D 88/522 16/75
4,355,732 A * 10/1982 Nessfield ..... B65D 88/522 108/55.3
4,966,085 A * 10/1990 Howe ..... B65D 88/129 108/56.1
7,270,236 B2 * 9/2007 Angeletti ..... B65G 49/062 211/195
8,453,861 B2 * 6/2013 Joubert ..... B65D 19/12 220/4.28
9,221,599 B2 * 12/2015 Brennan, Jr. ..... B65D 90/08
9,492,009 B2 11/2016 Naka et al.
10,589,924 B2 * 3/2020 Richardson ..... B65D 88/522
10,597,057 B1 3/2020 Hilmerson
2005/0188901 A1 * 9/2005 Arai ..... B65D 19/44 108/55.1
2010/0294785 A1 * 11/2010 Massa ..... B65D 88/522 220/666
2013/0233811 A1 * 9/2013 Glover ..... B65D 21/086 211/41.14
2018/0111751 A1 * 4/2018 Richardson ..... B65D 88/522

* cited by examiner

*Primary Examiner* — Ko H Chan
(74) *Attorney, Agent, or Firm* — Ice Miller LLP

(57) ABSTRACT

A storage rack for utility poles comprises a beam, and a post assembly that includes a support coupled to the beam, a post, a pivot pin rotatably coupling the post to the support, and a lock pin removably received in the support. The post is rotatable on the pivot pin between retracted and extended positions that are respectively parallel and perpendicular to the beam. The lock pin received in the support is positioned to contact the post in the retracted and extended positions, and restricts the rotation of the post in the retracted position toward the extended position, and the rotation of the post in the extended position toward the retracted position.

13 Claims, 8 Drawing Sheets

UTILITY POLE STORAGE RACK

BACKGROUND OF THE INVENTION

The present invention relates to industrial storage systems and, in particular, to storage racks for utility poles.

Construction and other industrial projects commonly require a lay down yard or temporary storage area for staging of materials and equipment close to the work site. The storage yard is preferably organized to provide efficient access to frequently used materials, save space at the work site, provide secure storage of the materials, and ensure worker safety. For example, utility companies often require storage of utility poles in inventory and at work sites. Wood utility poles generally range in length from 30 feet to greater than 60 feet, and can weigh between 500-2,000 lbs depending on the length and circumference of the pole. Concrete utility poles are substantially heavier than their wood counterparts. Storage of these large and heavy poles in loose and disorderly stacks creates a substantial workplace hazard. Retrieval of a pole may require workers to climb over an unstable pile, at the risk of injury from insecure footing and falling poles.

The use of industrial racks for the organized storage of utility poles is an essential worker safety measure. Storage of utility poles in racks allow workers to safely retrieve a pole from a secure location that minimizes the risk of accidents and injuries. Storage racks also increase the efficient use of space and resources by allowing greater vertical stacking and efficient arrangement of the utility poles.

Conventional utility pole storage racks are generally configured as a U-shaped frame comprising a beam with uprights extending perpendicularly at either end. The utility poles are received in the aperture of the U-shaped frame, and are generally sized to hold as many as 20-30 poles and to support a vertical load of as much as 60,000 lbs. At least two racks are spaced apart along the length of the utility poles to safely secure the poles. The total number of racks used depends on the length of the poles—e.g., one rack for every 20 ft of pole length.

The awkward U-shape of the storage racks, combined with their size and strength required to support a large number of utility poles, makes the racks heavy and unwieldy, and increases the difficulty of transporting the dozens of racks that may be required at a worksite, and of deploying, and rearranging the racks at the worksite. Therefore, it would be desirable to provide a storage rack with a compact profile that is more easily transported and deployed.

SUMMARY OF THE INVENTION

A storage rack for utility poles is disclosed, that comprises a beam and a post assembly. The beam has first and second beam ends, and a beam length extending between the first and second beam ends. The post assembly includes a support coupled to the first beam end, that comprises spaced apart first and second plates. The first plate has a first opening and the second plate has a second opening. A post is positioned between the first and second plates, the post having first and second post ends, and a third opening positioned between the first and second post ends. A pivot pin is received in the first, second, and third openings, and rotatably couples the post to the support. A lock pin is removably received in the support, and extends between the first and second plates. The first post is rotatable on the pivot pin between a first position extending substantially parallel to the beam length, and a second position extending substantially perpendicular to the beam length. The first post end extends away from the beam in the first position. The first post has a first post portion extending between pivot pin and the first post end, and a second post portion extending between the pivot pin and the second post end. The lock pin received in the first support is positioned externally to the post and is adjacent to the first post portion when the post is in the first position and in the second position, and substantially prevents the rotation of the post in the first position and in the second position.

In another embodiment, a storage rack, comprises a beam and a post assembly. The beam has first and second beam ends, and a beam length extending between the first and second beam ends. The post assembly includes a support coupled to the first beam end, that has a support opening. A post has first and second post ends. A pivot pin rotatably couples the post to the support. A lock pin is removably received in the support opening. The post is rotatable on the pivot pin between a first position extending substantially parallel to the beam length, and a second position extending substantially perpendicular to the beam length. The second post end extends away from the beam in the second position. The post has a first post portion extending between the pivot pin and the first post end, and a second post portion extending between the pivot pin and the second post end. The lock pin received in the support opening is positioned to contact the first post portion and substantially prevent the rotation of the post in the first position and in the second position.

DETAILED DESCRIPTION OF THE INVENTION

Figure 1:
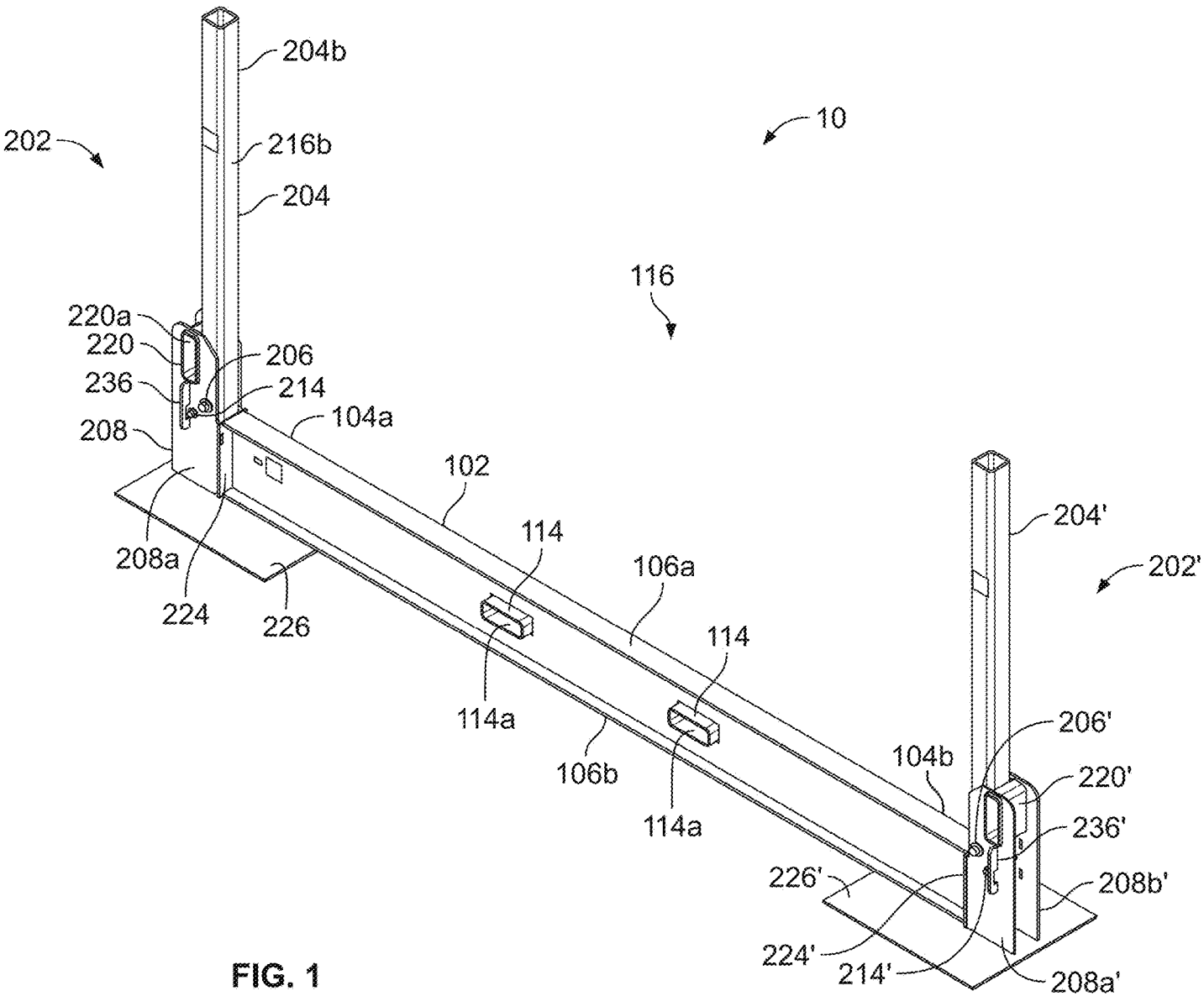
FIG. 1 is an isometric view of an embodiment of a utility pole storage rack in an extended position.

Referring to the drawings, an embodiment of a storage rack is shown. Storage rack 10 comprises a beam 102, and a post assembly 202. Beam 102 has opposite ends 104*a*, 104*b*, a beam length that extends between ends 104*a* and

104*b*, and top and bottom surfaces 106*a*, 106*b*. Beam 102 is preferably an I-beam that comprises a web 108 with top and bottom flanges 110*a*, 110*b* that respectively form top and bottom surfaces 106*a*, 106*b*.

Beam 102 may include one or more pockets to facilitate lifting and transport of storage rack 10—e.g., using a forklift. In one embodiment, beam 102 has two or more openings 112 that are spaced apart and aligned substantially parallel to the beam length. Beam openings 112 are positioned substantially symmetrically about the midpoint of the beam length, between the beam ends 104*a*, 104*b*. In a preferred embodiment, openings 112 are spaced apart, and are sized and shaped to receive the fork arms of a forklift. In a particularly preferred embodiment, openings 112 are sized and shaped to receive tubes 114 with channels 114*a*, that form pockets sized and shaped to receive the fork arms of a forklift.

Figure 11:
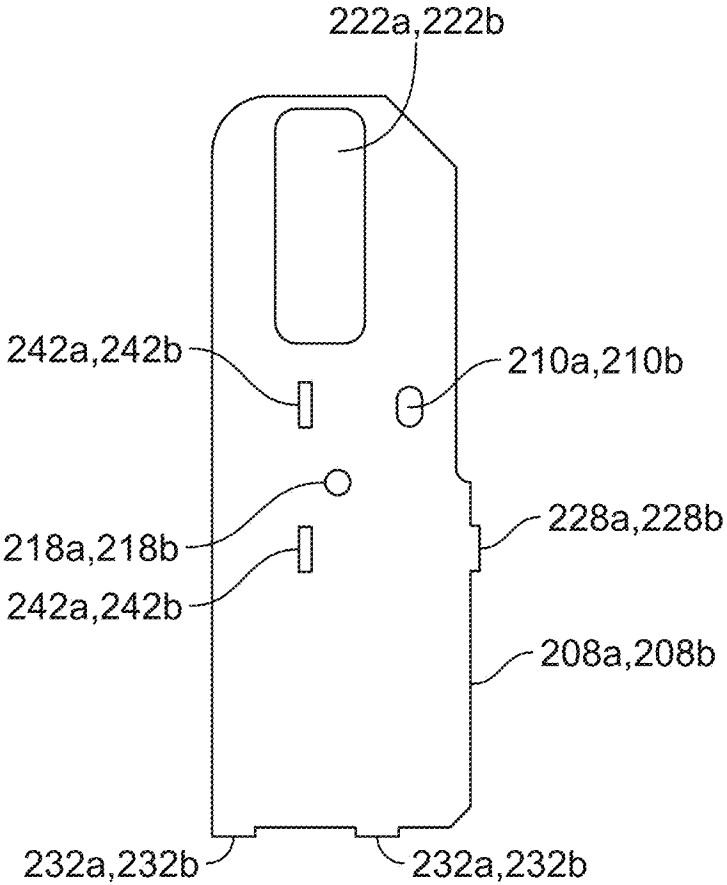
FIG. 11 is a front elevation view of a support plate of the storage rack of FIG. 1.
Figure 10:
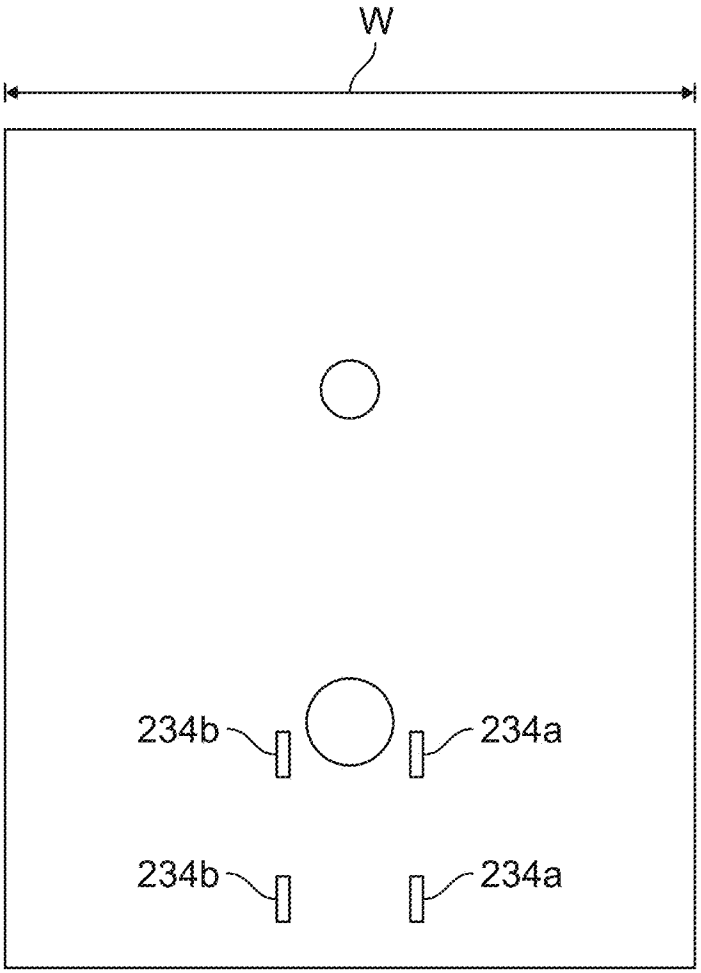
FIG. 10 is top plan view of a baseplate of the storage rack of FIG. 1.
Figure 13:
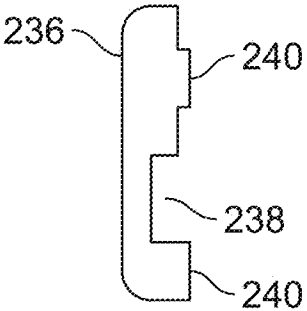
FIG. 13 is a side elevation view of a pin retention flange of the storage rack of FIG. 1.
Figure 14:
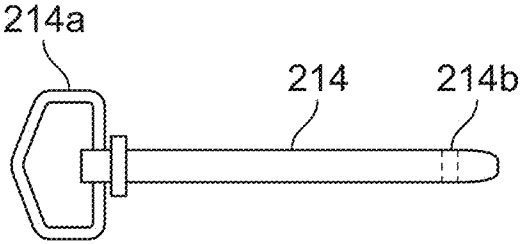
FIG. 14 is a side elevation view of a lock pin of the storage rack of FIG. 1.
Figure 12:
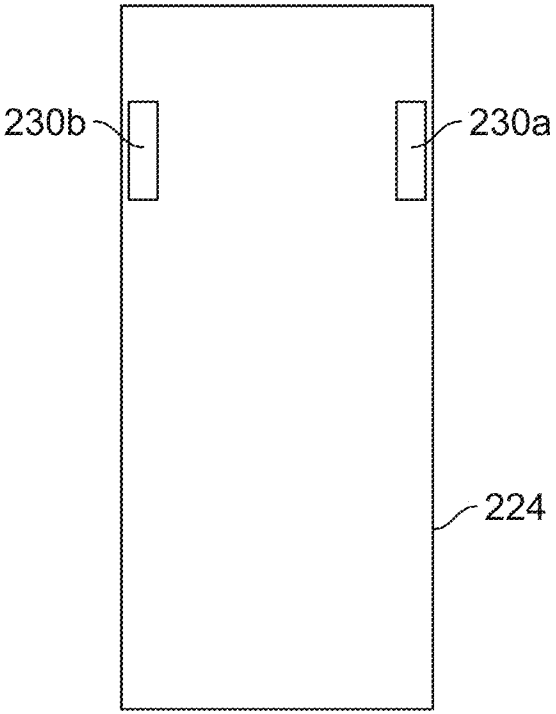
FIG. 12 is a side elevation view of an endplate of the storage rack of FIG. 1. top plan view of a baseplate of the storage rack of FIG. 1.

Post assembly 202 is positioned at beam end 104*a*, and comprises an upright or post 204, and a pivot pin 206 that rotatably couples post 204 to beam end 104*a*. In one embodiment, post assembly 202 includes a support 208 that is coupled to beam end 104*a*. Pivot pin 206 is received in support 208 and rotatably couples post 204 to the support and beam 102. In a preferred embodiment, support 208 comprises spaced apart first and second plates 208*a*, 208*b*, which respectively have openings 210*a*, 210*b* that are aligned, and are sized and shaped to receive pivot pin 206. FIG. 11 shows an embodiment of a plate 208*a*, which is identical to plate 208*b*. Pivot pin 206 is inserted through aligned openings 210*a*, 210*b* and extends between plates 208*a*, 208*b*.

Post 204 has opposite ends 204*a*, 204*b*, and an opening 212 positioned between the ends that is sized and shaped to receive pivot pin 206. In a preferred embodiment, post 204 is positioned between plates 208*a*, 208*b*, with post opening 212 aligned with support plate openings 210*a*, 210*b*. Pivot pin 206 is inserted through support plate openings 210*a*, 210*b* and post opening 212, to rotatably couple post 204 to support 208 and beam end 104*a*. In one embodiment, pivot pin 206 is a rod, or a rod-shaped fastener as are known in the art. For example, pivot pin 206 may comprise a threaded bolt or a hex screw 206*a*, and a nut 206*b* that secures the pivot pin in support 208. In a preferred embodiment, nut 206*b* is a lock nut that is not completely tightened on support 208, to allow pivot pin 206 to rotate and move laterally within openings 210*a*, 210*b*.

Figure 2:
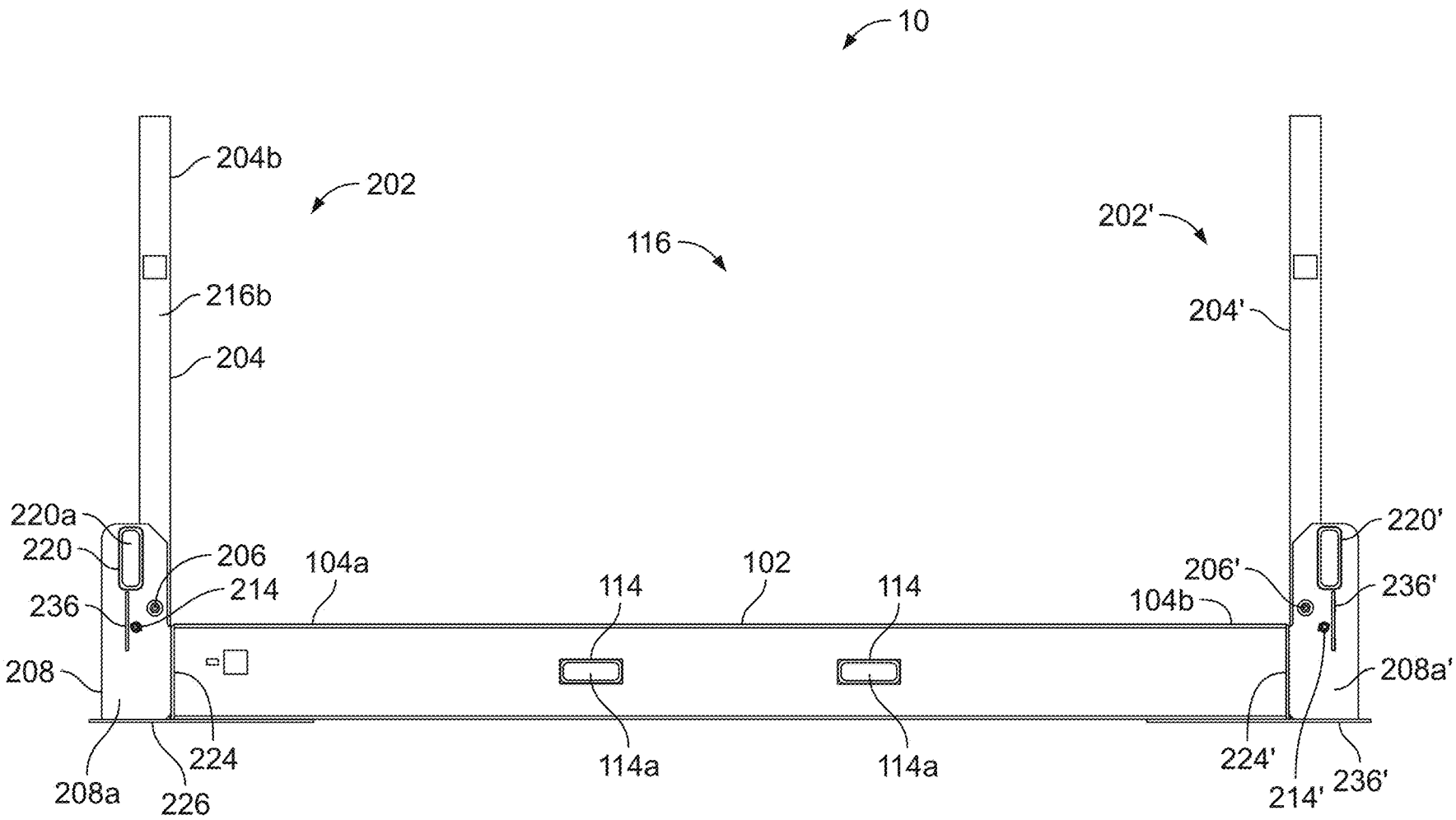
FIG. 2 is a front elevation view of the storage rack of FIG. 1.

Post 204 rotates on pivot pin 206 between a folded or retracted position extending substantially parallel to the beam length (FIG. 3), and an unfolded or extended position extending substantially perpendicular to the beam length (FIG. 2). In the retracted position, post end 204*b* is rotated toward beam 102, and post end 204*a* is rotated away from the beam and beam end 104*a*. In the extended position, post end 204*b* is rotated and extends away from beam 102, and post end 204*a* is rotated toward the beam and beam end 104*a*.

Pivot pin 206 is preferably loosely received in support 208, and is not tightly secured in the support. In one embodiment, pivot pin 206 is rotatable and moveable laterally within aligned openings 210*a*, 210*b*. For example, support plate openings 210*a*, 210*b* may have an oblong shape, with a length that extends vertically (perpendicular to the beam length) to allow pivot pin 206 to move laterally (vertically) within the openings. The lateral movement of pivot pin 206 provides manufacturing tolerance to ensure the rotation of post 204 between the fully retracted and fully extended positions.

Post 204 has an end portion 216*a* that extends between pivot pin 206 (opening 212) and end 204*a*, and an end portion 216*b* that extends between pivot pin 206 and end 204*b*. Post end portions 216*a*, 216*b* rotate about pivot pin 206, relative to beam 102. In the retracted position, end portion 216*a* rotates away from beam end 104*a*, and end portion 216*b* is rotated toward and preferably rests on beam top surface 106*a*. In the extended position, end portion 216*a* rotates toward beam end 104*a*, and end portion 216*b* is rotated away from beam top surface 106*a*.

Post assembly 202 may include a lock pin 214 that restricts the rotation of post 204, and preferably secures the post in the retracted position for transport of storage rack 10 and/or in the extended position for deployment and installation of the storage rack. In one embodiment, lock pin 214 is removably received in support 208 and is positioned to contact post end portion 216*a* and restrict the rotation of post 204 in the retracted (parallel) position toward the extended (perpendicular) position, and restrict the rotation of the post in the extended position toward the retracted position.

In a preferred embodiment, support plates 208*a*, 208*b*, respectively have openings 218*a*, 218*b* that are aligned, and sized and shaped to receive lock pin 214. Lock pin 214 is removably inserted through aligned openings 218*a*, 218*b* and extends between plates 208*a*, 208*b* transverse to the plane of rotation defined by the rotation of post 204 about pivot pin 206. In a particularly preferred embodiment, lock pin 214 is positioned in support 208 externally to post 204 and adjacent to post end portion 216*a* when the post is in the retracted (parallel) position, and when the post is in the extended (perpendicular) position. The position of lock pin 2014 adjacent to post end portion 216*a* secures and substantially prevents the rotation of post 204 in either the retracted or extended position. Therefore, the insertion of lock pin 214 in support 208 at a single position can alternately lock post 204 in either the retracted or extended positions.

It is desirable that storage rack 10 is operable by a single user, and that post 204 can be retracted or extended, and secured without the need for equipment or tools. In one embodiment, lock pin 214 is a removable rod that preferably has a loop, knob, or other handle 214*a* at one end to facilitate manual insertion and removal of the lock pin from support plates openings 218*a*, 218*b*. The other end of lock pin 214 preferably has an opening 214*b* that is sized and shaped to receive a locking device 214*c*, to releasably secure the lock pin in openings 218*a*, 218*b*. In a preferred embodiment, lock pin 214 is a hitch pin that has a loop handle 214*a* at one end, and an opening 214*b* for receiving locking device 214*c*. Locking device 214*c* is preferably a manually removable device, such as a pin clip, lynch pin, or other locking device known in the art.

Post assembly 202 may also include a stop 220 that supports and prevents overrotation of post 204 in the extended position. In one embodiment, stop 220 is positioned in support 208 to contact post end portion 216*b* when post 204 is rotated to the extended position, and to support and reinforce the post against further rotation beyond substantially perpendicular to beam 102 (i.e. rotation greater than 90° relative to the beam). Stop 220 may also be positioned in support 208 to contact post end portion 216*a* when post 204 is rotated to the retracted position, and to prevent further rotation beyond substantially parallel to beam 102. In a preferred embodiment, stop 220 extends between plates 208*a*, 208*b* transverse to the plane of rotation of post 204. Support plates 208*a*, 208*b*, respectively have openings 222*a*, 222*b* that are aligned and sized and shaped to receive stop 220. In a particularly preferred embodiment, stop 220 is a tube having a generally rectangular cross-section and a channel 220*a*, that extends between plates 208*a*, 208*b*.

In one embodiment, post assembly 202 includes an endplate 224 that couples support 208 to beam end 104*a*. Endplate 224 is positioned at beam end 104*a* and extends along a plane that is perpendicular to the beam length. Endplate 224 preferably provides an additional stop that prevents overrotation of post 204 in the extended position. As post 204 is rotated to the extended position, post end portion 216*a* is rotated into contact with endplate 224, which supports and reinforces the post against further rotation beyond substantially perpendicular to beam 102.

In one embodiment, post assembly includes a baseplate 226 that couples support 208 to beam 102, and provides a wider base for installation of storage rack 10 on the ground or other surface. Baseplate 226 is positioned at beam bottom surface 106*b*, and extends across beam end 104*a* and support 208, to couple the beam end to the support. In a preferred embodiment, Baseplate 226 extends along a plane that is substantially parallel to the beam length, and perpendicular to post 204 in the extended position. Baseplate 226 has a width W transverse to the beam length that is preferably greater than the corresponding width of beam 102 and the width of support 208, to increase the stability of storage rack 10 and to spread the weight of the storage rack and its load across a larger area.

Endplate 224 and/or baseplate 226 may be configured to facilitate proper assembly, positioning, and orientation of post assembly 202 on beam 102. In one embodiment, plates 208*a*, 208*b* respectively have tabs 228*a*, 228*b*, and endplate 224 has corresponding openings 230*a*, 230*b* that are sized and shaped to respectively receive tabs 228*a*, 228*b*. In another embodiment, plates 208*a*, 208*b* respectively have tabs 232*a*, 232*b*, and baseplate 226 has corresponding openings 234*a*, 234*b* that are sized and shaped to respectively receive tabs 232*a*, 232*b*. The insertion of tabs 228*a*, 228*b* into openings 230*a*, 230*b*, and/or the insertion of tabs 232*a*, 232*b* in openings 234*a*, 234*b* properly spaces apart and aligns plates 208*a*, 208*b* to receive post 204, pivot pin 206, and lock pin 214, and also properly positions pivot pin 206 relative beam 102.

Figure 5:
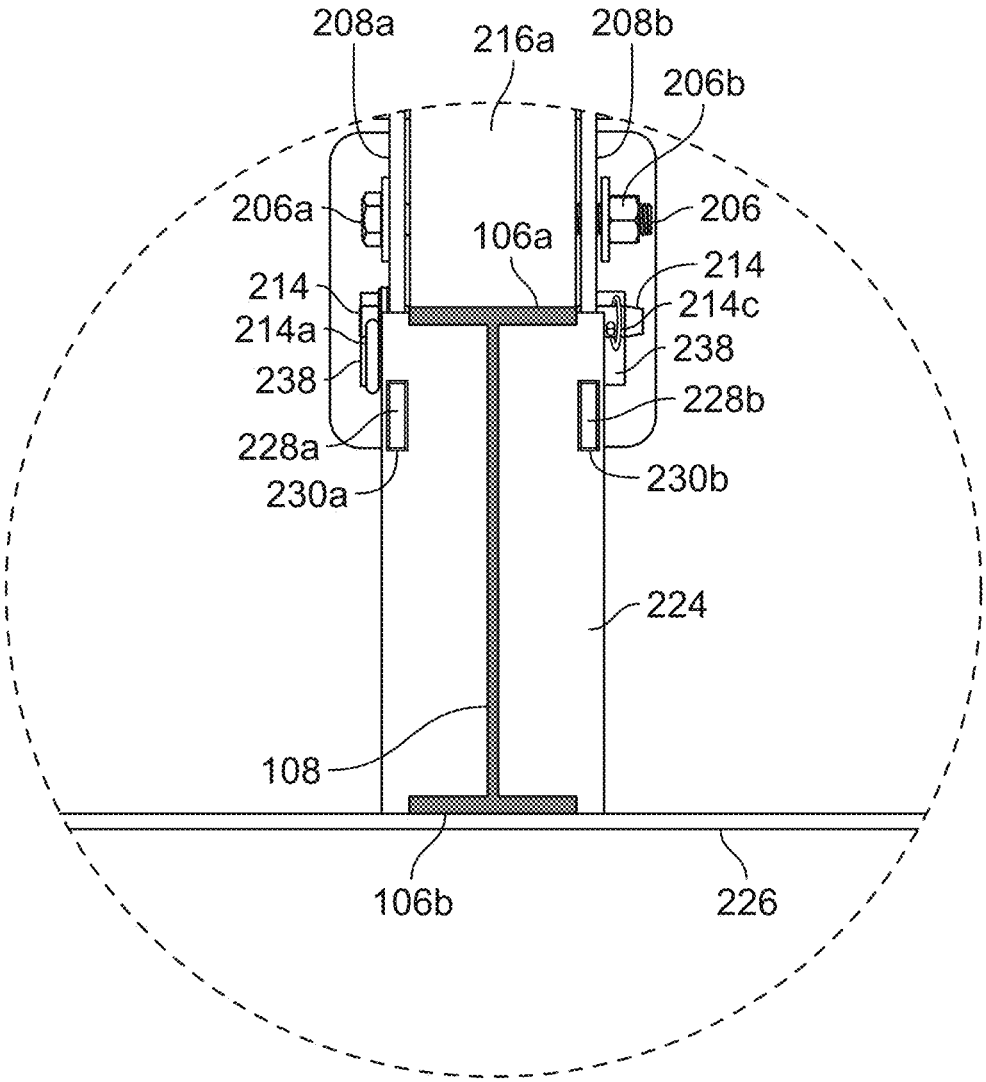
FIG. 5 is a detail, side section view of the post assembly of the storage rack of FIG. 1.
Figure 6:
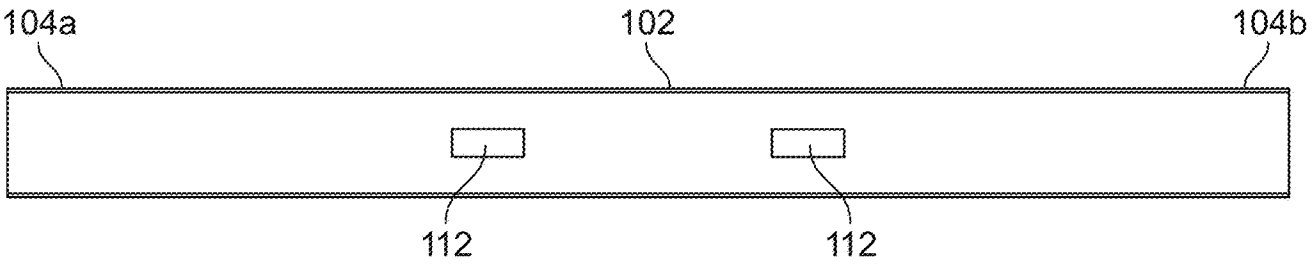
FIG. 6 is a front elevation view of the beam of the storage rack of FIG. 1.
Figure 8:
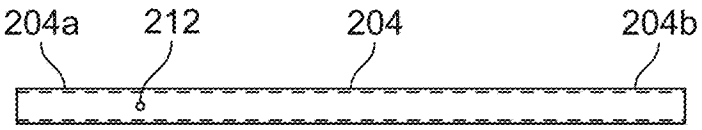
FIG. 8 is a front elevation view of a post of the storage rack of FIG. 1.
Figure 9:
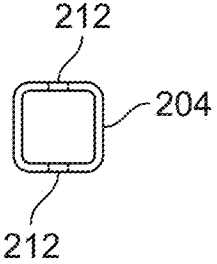
FIG. 9 is a top section view of the post of FIG. 8.
Figure 7:
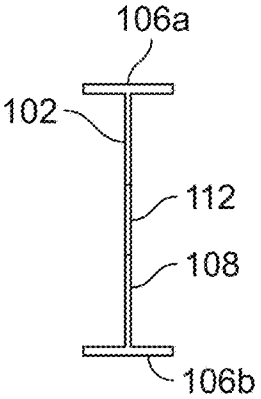
FIG. 7 is a side section view of the beam of FIG. 6.

Post assembly 202 may include one or more guard flanges 236 that are positioned adjacent to lock pin 214, to protect the lock pin from inadvertent removal from the support. In one embodiment, guard flange 236 and lock pin 214 project from support 208—e.g., project from plate 208*a* and/or 208*b*. Guard flange 236 is configured to project from support 208 as at a height greater than lock pin 214 (e.g, lock pin handle 214*a* or lynch pin 214*c*), to protect the lock pin from inadvertent impacts or removal from the support. In a preferred embodiment, guard flange 236 forms a cutout or opening 238 that is sized and shaped to receive and cover a portion of lock pin handle 214*a* or lynch pin 214*c*, as shown in FIG. 5.

Flange 236 may include one or more tabs 240 to ensure proper positioning on support 208 to protect pivot pin 206 and lock pin 214. In one embodiment, plates 208*a* and 208*b* respectively have corresponding openings 242*a*, 242*b* that are sized and shaped to receive flange tabs 240. The insertion of tabs 240 in openings 242*a* and 242*b* properly positions flange 238 on plates 208*a* and 208*b* adjacent to pivot pin 206, to protect the pivot pin.

In one embodiment, the various elements of post assembly 204 are made of steel, and are preferably formed from 0.375 inch steel plate and welded together. In a preferred embodiment, beam 102 is a steel I-beam having a length of about 144 inches, and a height of about 12.25 inches (e.g., above baseplate 226). Beam openings 112 or pockets 114 are preferably spaced apart along the beam length by about 36 inches, and are sized and shaped to receive the fork arms of a forklift. Post 204 is a steel tube having a length of about 78 inches and a wall thickness of 0.375 inches. In a preferred embodiment, post 204 has a square cross-section with an outside width of about 4 inches. Post end portion 216*a* has a length between pivot pin 206 and post end 204*a* of about 14.375 inches. Support 208 comprises steel plates 208*a* and 208*b* that are spaced apart by an width of about 4.625 inches, and that have aligned openings 210*a*, 210*b* that are positioned at a height of about 14.875 inches on center (e.g., above baseplate 226). Pivot pin 206 is preferably a steel hex cap screw with a length of about 6.5 inches and a body diameter of about 0.75 inches. Lock pin 214 is preferably a hitch pin having a length of about 5.25 inches and a diameter of about 0.75 inches, and is secured by a lynch pin. Baseplate 226 is a steel plate having a width W of about 23.875 inches and a length of about 29 inches.

The storage rack may comprise a plurality of post assemblies, that are preferably independently rotatable between their extended and retracted positions. In one embodiment, storage rack (10) comprises two post assemblies 202 and 202', that are respectively positioned at opposite beam ends 104*a*, 104*b*. Post assembly 202' preferably has the mirror image configuration of post assembly 202 described above, and is independently operable from post assembly 202. For example, post assembly 202' may comprise a post 204', a pivot pin 206', a support 208' including plates 208*a'* and 208*b'*, a lock pin 214', a stop 220', an endplate 224', and a baseplate 226' that have the mirror image configuration and arrangement as described for the corresponding post 204, pivot pin 206', support 208' with plates 208*a* and 208*b*, lock pin 214, stop 220, endplate 224, and a baseplate 226. Support 208' and endplate 224' are coupled to beam end 104*b*, and baseplate 226' extends across beam end 104*b* and support 208', as previously described for post assembly 202.

Figure 3:
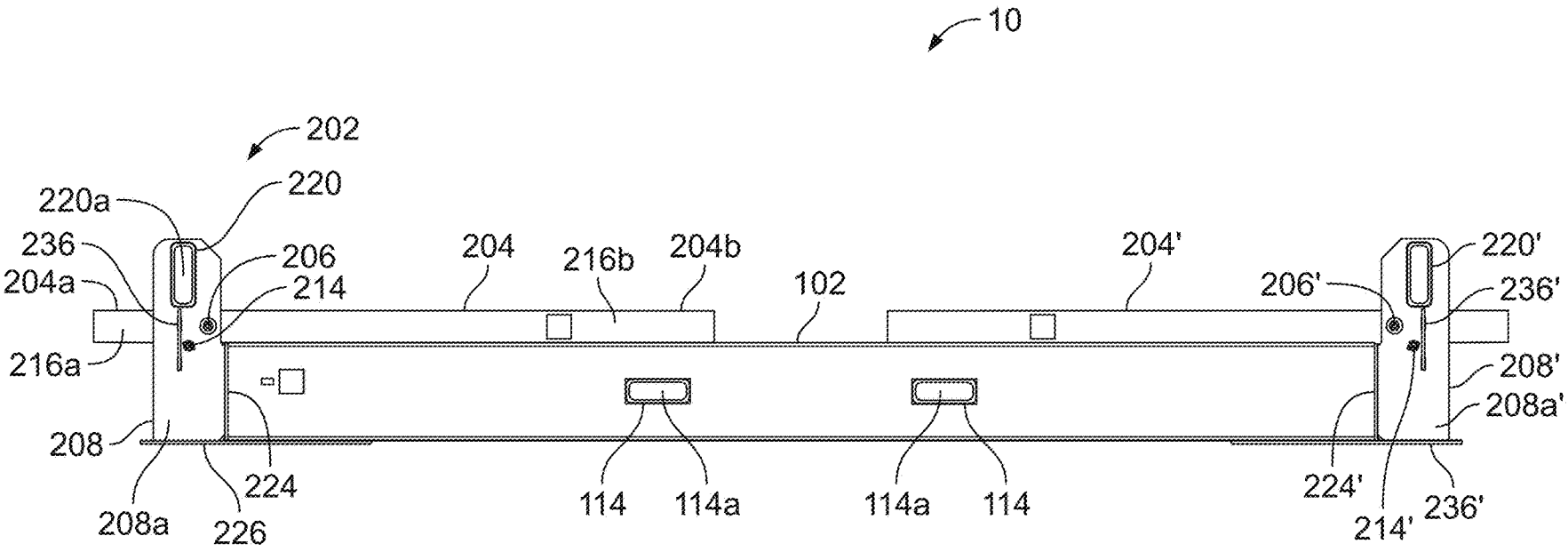
FIG. 3 is a front elevation view of the storage rack of FIG. 1, in a retracted position.
Figure 4:
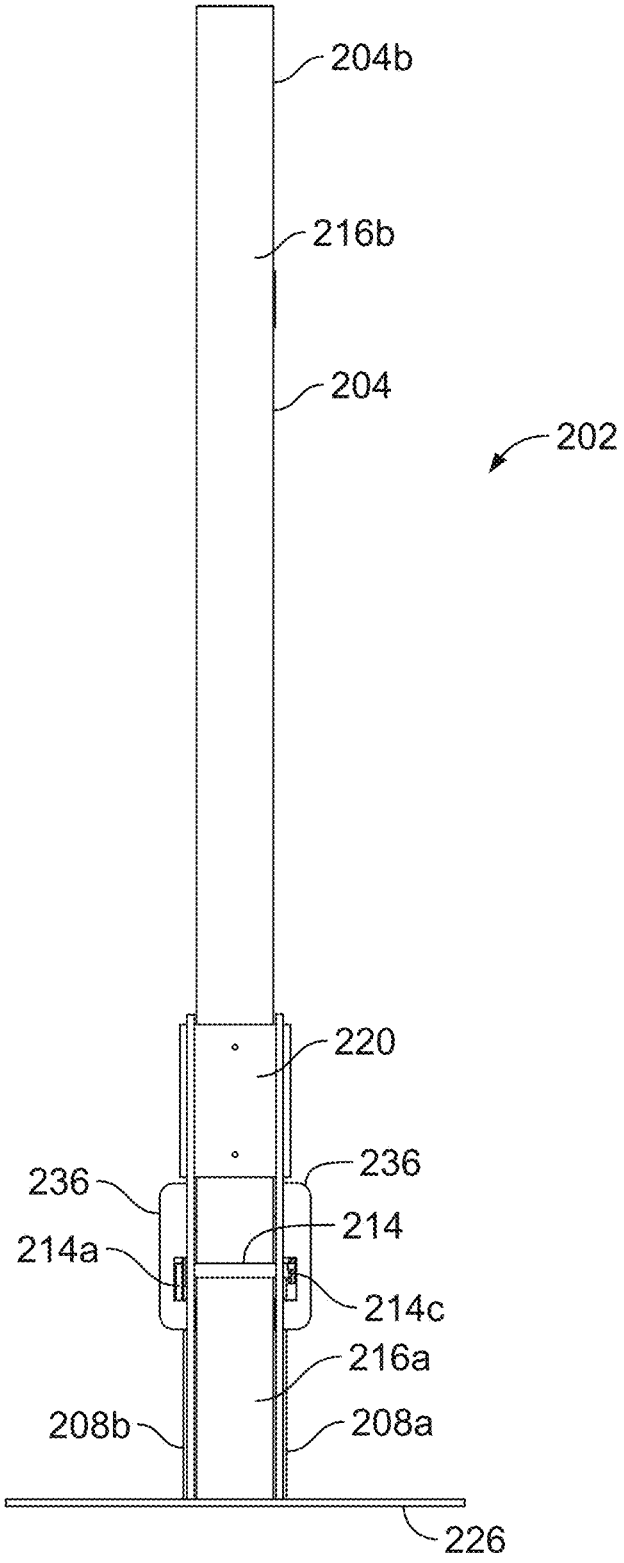
FIG. 4 is an side elevation view of the storage rack of FIG. 1.

Storage rack 10 is deployed or installed by rotating posts 204 and 204' to their extended positions. Because of their mirror image configurations, posts 204 and 204' rotate from their retracted positions to their extended positions in opposite directions and away from each other—e.g., respectively counter-clockwise and clockwise, as shown in FIGS. 1-3. As shown in FIGS. 1 and 2, beam 102 and extended posts 204, 204' form a U-shaped receptacle, with an aperture 116 defined between the beam and posts for receiving utility poles or other loads. In one embodiment, aperture 116 has an interior width between extended posts 204, 204' of about 145 inches, and an interior height extending between beam 102 and post end 204*b* of about 66 inches.

While particular embodiments of the present disclosure have been illustrated and described, it would be obvious to those skilled in the art that various other changes and modifications can be made without departing from the spirit and scope of the present disclosure. It is therefore intended to cover in the appended claims all such changes and modifications that are within the scope of this disclosure.

What is claimed is:

1. A storage rack, comprising:

a beam having first and second beam ends, and a beam length extending between the first and second beam ends; and a first post assembly, including:

a first support coupled to the first beam end, and comprising spaced apart first and second plates, the first plate having a first opening and the second plate having a second opening;

a first post positioned between the first and second plates, the first post having first and second post ends, and a third opening positioned between the first and second post ends;

a first pivot pin received in the first, second, and third openings, and rotatably coupling the first post to the first support, wherein the first pivot pin is rotatable and moveable laterally within the first and second openings; and a lock pin removably received in the first support, and extending between the first and second plates;

wherein the first post is rotatable on the first pivot pin between a first position extending substantially parallel to the beam length, and a second position extending substantially perpendicular to the beam length, the first post end extending away from the beam in the first position;

wherein the first post has a first post portion extending between the first pivot pin and the first post end, and a second post portion extending between the first pivot pin and the second post end; and wherein the lock pin received in the first support is positioned externally to the first post and is adjacent to the first post portion when the first post is in the first position and in the second position, and substantially prevents the rotation of the first post in the first position and in the second position.

2. The storage rack of claim 1, wherein the first pivot pin comprises a hex screw and lock nut.

3. A storage rack, comprising:

a beam having first and second beam ends, and a beam length extending between the first and second beam ends; and a post assembly, including:

a support coupled to the first beam end, and comprising spaced apart first and second plates, the first plate having a first opening and the second plate having a second opening;

a post positioned between the first and second plates, the post having first and second post ends, and a third opening positioned between the first and second post ends;

a pivot pin received in the first, second, and third openings, and rotatably coupling the post to the support; and a lock pin removably received in the support, and extending between the first and second plates, wherein the lock pin comprises a hitch pin and lynch pin;

wherein the post is rotatable on the pivot pin between a first position extending substantially parallel to the beam length, and a second position extending substantially perpendicular to the beam length, the first post end extending away from the beam in the first position;

wherein the post has a first post portion extending between the pivot pin and the first post end, and a second post portion extending between the pivot pin and the second post end; and wherein the lock pin received in the support is positioned externally to the post and is adjacent to the first post portion when the post is in the first position and in the second position, and substantially prevents the rotation of the post in the first position and in the second position.

4. A storage rack, comprising:

a beam having first and second beam ends, and a beam length extending between the first and second beam ends; and a post assembly, including:

a support coupled to the first beam end, and comprising spaced apart first and second plates, the first plate having a first opening and the second plate having a second opening;

a post positioned between the first and second plates, the post having first and second post ends, and a third opening positioned between the first and second post ends;

a pivot pin received in the first, second, and third openings, and rotatably coupling the post to the first support;

a stop extending between the first and second plates; and a lock pin removably received in the support, and extending between the first and second plates;

wherein the post is rotatable on the pivot pin between a first position extending substantially parallel to the beam length, and a second position extending substantially perpendicular to the beam length, the first post end extending away from the beam in the first position;

wherein the post has a first post portion extending between the pivot pin and the first post end, and a second post portion extending between the pivot pin and the second post end;

wherein the lock pin received in the support is positioned externally to the post and is adjacent to the first post portion when the post is in the first position and in the second position, and substantially prevents the rotation of the post in the first position and in the second position; and wherein the stop is positioned to contact the second post portion in the second position and restrict rotation of the first post beyond perpendicular to the beam length.

5. A storage rack, comprising:

a beam having first and second beam ends, and a beam length extending between the first and second beam ends; and a post assembly, including:

a support coupled to the first beam end, and comprising spaced apart first and second plates, the first plate having a first opening and the second plate having a second opening;

a post positioned between the first and second plates, the post having first and second post ends, and a third opening positioned between the first and second post ends;

a pivot pin received in the first, second, and third openings, and rotatably coupling the post to the support;

an endplate coupling the support to the first beam end; and a lock pin removably received in the support, and extending between the first and second plates;

wherein the post is rotatable on the pivot pin between a first position extending substantially parallel to the beam length, and a second position extending substantially perpendicular to the beam length, the first post end extending away from the beam in the first position;

wherein the post has a first post portion extending between the pivot pin and the first post end, and a second post portion extending between the pivot pin and the second post end;

wherein the lock pin received in the support is positioned externally to the post and is adjacent to the first post portion when the post is in the first position and in the second position, and substantially prevents the rotation of the post in the first position and in the second position; and wherein the endplate is positioned to contact the first post portion in the second position and restrict rotation of the first post beyond perpendicular to the beam length.

6. A storage rack, comprising:

a beam having first and second beam ends, top and bottom surfaces, and a beam length extending between the first and second beam ends; and a post assembly, including:

a support coupled to the first beam end, and comprising spaced apart first and second plates, the first plate having a first opening and the second plate having a second opening;

a post positioned between the first and second plates, the post having first and second post ends, and a third opening positioned between the first and second post ends;

a pivot pin received in the first, second, and third openings, and rotatably coupling the post to the support;

a lock pin removably received in the support, and extending between the first and second plates; and a baseplate coupled to the support and beam bottom surface;

wherein the post is rotatable on the pivot pin between a first position resting on the beam top surface and extending substantially parallel to the beam length, and a second position extending substantially perpendicular to the beam length, the first post end extending away from the beam in the first position;

wherein the post has a first post portion extending between the pivot pin and the first post end, and a second post portion extending between the pivot pin and the second post end; and wherein the lock pin received in the support is positioned externally to the post and is adjacent to the first post portion when the post is in the first position and in the second position, and substantially prevents the rotation of the post in the first position and in the second position.

7. A storage rack, comprising:

a beam having first and second beam ends, and a beam length extending between the first and second beam ends; and a post assembly, including:

a support coupled to the first beam end, and comprising spaced apart first and second plates, the first plate having a first opening and the second plate having a second opening;

a post positioned between the first and second plates, the post having first and second post ends, and a third opening positioned between the first and second post ends;

a pivot pin received in the first, second, and third openings, and rotatably coupling the post to the support;

a lock pin removably received in the support, and extending between the first and second plates; and a guard flange positioned on the first support adjacent to the lock pin;

wherein the post is rotatable on the pivot pin between a first position extending substantially parallel to the beam length, and a second position extending substantially perpendicular to the beam length, the first post end extending away from the beam in the first position;

wherein the post has a first post portion extending between the pivot pin and the first post end, and a second post portion extending between the pivot pin and the second post end;

wherein the lock pin received in the support is positioned externally to the post and is adjacent to the first post portion when the post is in the first position and in the second position, and substantially prevents the rotation of the post in the first position and in the second position; and wherein the lock pin projects from the first support at a first height, and the guard flange projects from the support at a second height greater than the first height.

8. The storage rack of claim 7, wherein the guard flange forms a flange opening; and wherein the lock pin is received in the first support with at least a portion of the lock pin received in the flange opening.

9. The storage rack of claim 1, wherein the beam length has a midpoint between the first and second beam ends; and wherein the beam further comprises first and second beam openings that are spaced apart and aligned substantially parallel to the beam length, and are positioned substantially symmetrically to the midpoint.

10. The storage rack of claim 1, further comprising a second post assembly, including:

a second support coupled to the second beam end;

a second post; and a second pivot pin rotatably coupling the second post to the second support;

wherein the second post is rotatable on the second pivot pin between a third position extending substantially parallel to the beam length, and a fourth position extending substantially perpendicular to the beam length; and wherein the rotation of the first post to the second position and the rotation of the second post to the fourth position, rotates the first and second posts away from each other, and forms a U-shaped receptacle having an aperture defined between the beam, and first and second posts.

11. A storage rack, comprising:

a beam having first and second beam ends, and a beam length extending between the first and second beam ends; and a post assembly, including:

a support coupled to the first beam end, and having first and second support openings;

a post having first and second post ends;

a pivot pin received in the first support opening, and rotatably coupling the post to the support; and a lock pin removably received in the second support opening;

wherein the pivot pin is rotatable and moveable laterally within the first support opening;

wherein the post is rotatable on the pivot pin between a first position extending substantially parallel to the beam length, and a second position extending substantially perpendicular to the beam length, the second post end extending away from the beam in the second position;

wherein the post has a first post portion extending between the pivot pin and the first post end, and a second post portion extending between the pivot pin and the second post end; and wherein the lock pin received in the support opening is positioned to contact the first post portion and substantially prevent the rotation of the post in the first position and in the second position.

12. The storage rack of claim 11, wherein the support comprises spaced apart first and second plates; and the pivot pin extends between the first and second plates, and the first post is rotatable on the pivot pin between the first and second plates.

13. The storage rack of claim 11, wherein the rotation of the post on the pivot pin defines a plane of rotation, and the lock pin received in the support extends transverse to the plane of rotation.

* * * * *